United States Patent [19]

Stone et al.

[11] Patent Number: 4,918,568

[45] Date of Patent: Apr. 17, 1990

[54] AIR QUALITY CONTROL SYSTEMS

[75] Inventors: Judson F. Stone, Northfield; Harold O. Schwartz, Elburn, both of Ill.

[73] Assignee: Air Physics Corporation, Northfield, Ill.

[21] Appl. No.: 184,762

[22] Filed: Apr. 22, 1988

[51] Int. Cl.[4] ..... H01T 23/00

[52] U.S. Cl. ..... 361/231; 361/235

[58] Field of Search ..... 361/213, 230, 231, 235

[56] References Cited

U.S. PATENT DOCUMENTS

| | | | |
|---|---|---|---|
| 2,264,495 | 12/1941 | Wilner | 361/235 X |
| 3,711,743 | 1/1973 | Bolasny | 361/235 X |
| 3,936,698 | 2/1976 | Meyer | 361/235 X |
| 4,107,756 | 8/1978 | Best et al. | 361/231 |
| 4,672,504 | 6/1987 | Stone | 361/231 |
| 4,740,862 | 4/1988 | Halleck | 361/231 |
| 4,757,421 | 7/1988 | Mykkanen | 361/231 |

*Primary Examiner*—L. T. Hix
*Assistant Examiner*—D. Rutledge
*Attorney, Agent, or Firm*—James P. Ryther

[57] ABSTRACT

Air quality control systems for rooms or other enclosed spaces relying on generators which supply charges to particles present in the air thereby purifying or otherwise controlling the condition of the air. A source of high voltage is connected to radiating surfaces of various configurations carrying electrostatic charges. A fan or other air circulating device including natural air movement insures adequate contact of the air with the charges generated to thereby achieve the desired quality control. Operating mechanisms provided in the system include voltage varying circuitry to permit adjustment of the generating intensity. A sensor is provided to detect variations in conditions thereby permitting automatic voltage variations. A remote control station is comtemplated where independent environments may be involved and where separate control of these environments is desired. Switching of the system polarity enable production of positive or negative electrostatic charges depending on the atmospheric conditions encountered.

19 Claims, 4 Drawing Sheets

AIR QUALITY CONTROL SYSTEMS

BACKGROUND OF THE INVENTION

Small particles such as dust, smoke, organisms in the rooms of buildings, etc., generally tend to carry a positive electrical charge. Such small particles tend to be repelled bY the statically positive building structures and the like, and therefore to remain in suspension in the air.

It previously has been recognized that generation of negative ions will cause such positive particles of dust, smoke, etc., to be attracted to the ions, and to form sufficiently large particles physically that they will drop gravitationally to the earth or floor, as well as to be negatively charged for attraction to the earth, floor or walls. Negative ions also dispel static electricity which is often troublesome.

The foregoing has been recognized in the patent art, as for example U.S. Pat. Nos. 4,037,268 and 4,109,290, and the art of record therein, which discuss the benefits of removing particulate material from the air.

U.S. Pat. No. 4,672,504 discloses a generator for air purification, and specifically for the production of negative ions. This device is provided with a motor driven fan for circulating air. A housing is provided through which the air is circulated, and a large dome is housed within the housing. The dome is made of plastic or other insulating material and is hermetically sealed to a base within the housing.

The high voltage portions of this air purifier are disposed under the dome and hence in an inaccessible position, thereby assuring electrical safety. The inner surface of the dome is covered or coated with an electrically conductive material and a negative high voltage DC source is connected to the coating. This produces a negative electrostatic field over the entire outer surface of the dome. The outer surface of the dome then cause air particles to become negatively charged.

SUMMARY OF THE INVENTION

This invention relates to improved systems applicable to structures of the type described in U.S. Pat. No. 4,672,504 as well as to other configurations. Generally speaking, the invention contemplates systems which are desirable for use in controlling the condition of air in enclosed spaces such as rooms occupied by people for business or personal reasons. Such enclosed spaces may also benefit from the control of the condition of air for scientific or other purposes.

The invention generally comprises a system wherein a source of high voltage is employed for applying electrostatic charges to a charge radiating surface. This surface, which may comprise a wall or other exposed surface in an enclosed space, is adapted to develop either a positive or negative electrostatic charge thereby providing versatility from the standpoint of applications where the system can be effectively utilized.

Means are provided for circulating air relative to the charge radiating surface. Specific means such as a fan may be employed, but natural air circulation may provide such means in some circumstances. Such natural circulation may be caused, for example, by the movement of persons in a room.

A particular feature of the invention relates to the ability to switch between a positive and negative electrostatic charge. Thus, the system may be employed for removing positive particles such as dust from the air in the manner previously described, or for purposes of developing positive or negative balances in the air when this provides a more suitable environment for comfort, for scientific purposes, or for other reasons.

The system of the invention also contemplates the provision of means for controlling the magnitude of high voltage applied so that variations in conditions within an enclosed space may be dealt with effectively. In this same connection, the invention contemplates the use of detecting means for determining the condition of air in an enclosed space from the standpoint of positively or negatively charged particles present in the air, so that the system can deal with variations in conditions to maintain a desired atmosphere.

The invention also contemplates the use of a microprocessor control means connected between the detecting means and the charging arrangement. The microprocessor control means can then serve to determine when polarity switching is desired, and may also be employed for varying the magnitude of the high voltage applied in the system.

The system of the invention contemplates the location of a control means in a space remote from the enclosed space where the air quality is being determined. Such a remote control system is a particular advantage where a plurality of such enclosed spaces is involved whereby conditions may be varied in separate locations depending upon particular needs. The use of computers in connection with such control means, including the use of different programs as variation in conditions requires, is also contemplated.

DESCRIPTION OF THE DRAWINGS

The present invention will best be understood from the following specification when taken in connection with the accompanying drawings wherein.

DESCRIPTION OF THE PREFERRED EMBODIMENTS

Figure 1:
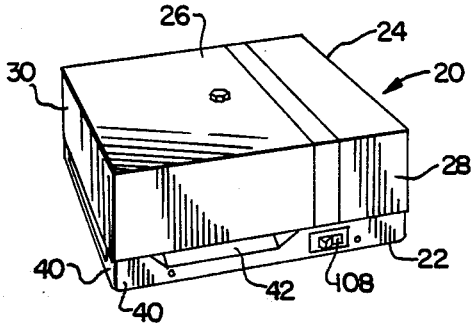
FIG. 1 is a perspective view of an electron generator constructed generally in accordance with U.S. Pat. No. 4,672,504 but adapted in accordance with the present invention.
Figure 2:
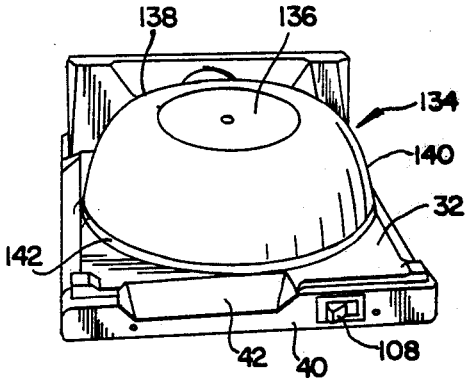
FIG. 2 is a perspective view similar to FIG. 1 with the cover of the housing removed.
Figure 3:
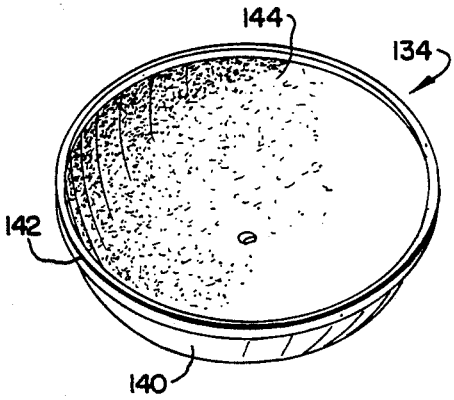
FIG. 3 is a perspective view on an enlarged scale of the dome previously shown in FIG. 2, in an inverted position.
Figure 4:
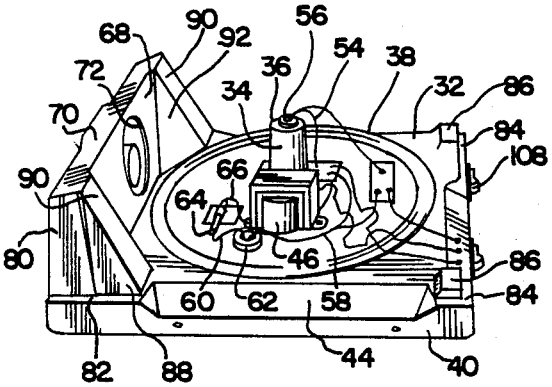
FIG. 4 is a perspective view of the base of the housing with the dome removed, taken substantially at right angles to FIGS. 1 and 2.
Figure 5:
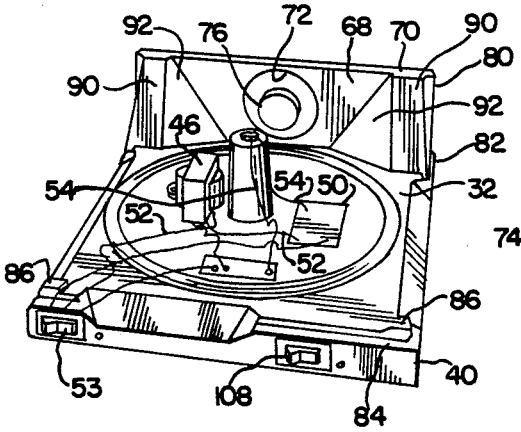
FIG. 5 is a perspective view of the base generally similar to FIG. 4 and taken substantially at right angles thereto.
Figure 6:
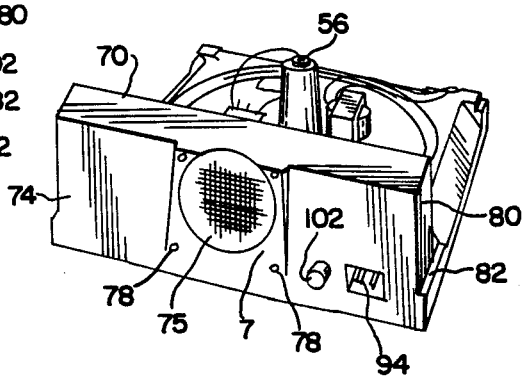
FIG. 6 is another perspective view of the base of the housing taken at substantially 180 degrees relative to FIG. 5 and showing what might be considered to be the rear side of the base.

Turning now in greater particularity to the drawings there will be seen a generator 20 for air purification having a configuration generally as shown in the aforementioned U.S. Pat. No. 4,672,504. This air purifier is generally rectangular in shape and includes a base 22 and a top housing or cover 24. The housing is rectangular, nearly square in outline, and includes a top wall 26, a front wall 28 at right angles thereto, and a pair of side walls 30. The back is open as will appear shortly.

The base 22 includes a generally flat floor 32 having an upstanding central boss 34 which comprises a frustum of a cone tapering at a shallow angle, and being terminated and substantially closed at the upper end by a horizontal wall 36. This wall is apertured for receipt of a bolt as hereinafter described, and may be threaded. An annular rib 38 is spaced out from the boss 34 and upstands from the surface of the floor 32.

The floor 32 of the base 22 is provided on the front and both sides with a depending flange 40. Portions of the junctions of this flange with the floor are relieved at 42 at the front, and at 44 on the sides. This provides vents for egress of air from within the purifier as will be apparent hereinafter.

Figure 7:
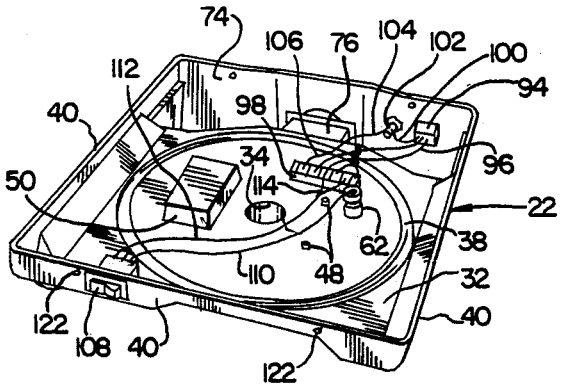
FIG. 7 is an inverted view of the base taken from the same direction as FIG. 5 and with the floor removed.

The floor 32 has a transformer 46 upstanding therefrom and secured by screws or the like 48 (FIG. 7) extending through the floor from the underside thereof and threaded into suitable portions of the transformer. Suitable high voltage rectifier circuits are mounted in a well 50 in the floor and may be potted in place. Suitable wires 52 extend between the transformer and the rectifiers through switch 53, and single high voltage wires 54 extend from the respective rectifier units to a terminal or washer 56 resting on the horizontal wall 36 at the top of the boss 34.

For each rectifier circuit, a pair of wires 58 and 60 extend through a grommet 62 fitting through a hole in the floor 32. The wires are sealed in the grommet in a suitable plastic or rubber compound so that the floor is effectively sealed. The wire 58 leads to the rectifier unit and may be considered a ground wire, being returned through one of the wires 52 to the transformer 56. The other wire 60 extends to a fuse 64 suitably mounted on the floor 32 and a wire 66 leads from the other end of the fuse to the second lead of the transformer 46. The transformer, as will be understood, is connected to the usual 120 volt line by wires hereinafter to be mentioned and provides a high voltage output to the rectifier unit 50 which then supplies a high voltage direct current out on the wire 54 to the washer or terminal 56. The high voltage direct current is on the order of 10,000 to 24,000 volts, and the polarity on the wire or lead 54 may be positive or negative. The system will develop positive or negative electrostatic charges depending on the position of switch 53.

At the rear of the floor 32, there is an upstanding wall 68 which inclines slightly outwardly as it moves up from the floor. The wall 68 is surmounted by a narrow top wall 70. The wall 68 is provided centrally with a circuit aperture 72. A depending rear wall 74 extends down to a level with the side flanges 40 and is provided with a central flat portion 72 closed by a screen or grill 75. A muffin fan 76 is secured behind the screen 74 such as by screw threaded fasteners 78 extending through the flat central portion 72 of the wall 74. As is known, a muffin fan includes an electric motor and a blower which may be of the blade or centrifugal type. The fan 76 pulls in outside air through the screen 75 and expels it into the interior of the generator through the opening 72 in the wall 68.

Vertical end walls 80 interconnect the rear wall 68, the top wall 70 and back wall 74 and extend down to the top of the floor 32, including rearward extensions thereof, leaving a narrow ledge 82 outwardly of each wall 80 for the respective side walls 30 of the top cover to rest on. At the front corners of the base there are additional ledges 84 coplanar with the ledges 82 and with the floor 32 on which the front wall 28 and the front portions of the side walls 30 of the cover rest. Upstanding bosses 86 adjacent the ledges 84 position the front corners of the cover 24.

The walls 80 are provided with inset tapered, bracing walls 88 extending to the floor 32. Diagonal walls 90 extend between the walls 88, the floor 32 and the top wall 70, while inset or gussetted walls 92 join the walls 90 to the upstanding wall 68 and to the floor 32.

All of the parts of the base as heretofore shown and described comprise a single vacuum formed plastic member. A separable electrical connector 94 is provided in the back wall 74 and has electric wires 96 leading therefrom to a terminal block 98 suitably secured to the underside of the floor 32. Another wire 100 leads to a fuse 102 also mounted in the back wall 74. The opposite terminal of the fuse is connected by a wire 104 to the muffin fan 76, specifically the motor thereof. The other wire 106 from the fan motor is connected to the junction block 98. An on-off rocker switch 108 is mounted in the front flange 40 and has one wire 110 therefrom extending into the grommet 61, while the other wire 112 therefrom extends to the junction block 98, there being a second wire 114 from the junction block into the grommet 62, these wires continuing at the inner end of the grommet as the wires 58 and 60 previously referred to.

A bottom plate 116 underlies the floor 32 and is spaced therefrom, and is provided with an upstanding peripheral flange 118 having suitably positioned sheet metal nuts 120 clipped thereon, appropriate apertures being formed in the flange 18 for receipt of the sheet metal nuts 120. Screw fasteners extend through aligned apertures 122 in the front and side flanges 40 for passage of screws which are threaded into the sheet metal nuts 120 to secure the bottom plate 116 in position. The bottom plate comprises another integral sheet plastic vacuum formed member, and includes a central rib 124 extending from the front to the back of the base 22. A central boss 126 upstands from the rib 124, and the rib will be understood as for bracing purposes. The central boss 126 is of larger diameter than the boss 34, and has an upper wall 128 underlying and bracing the floor 32. A central protuberance 130 of the boss 126 extends upwardly within the boss 134 a short distance for relative location of the parts.

A further important element of the present invention comprises a power dome 134. This dome may be of different selected concave-convex shapes, and in the present illustrative embodiment comprises a generally flat top 136 with a downwardly curved shoulder portion 138 leading to a downwardly and outwardly diverging frusto-conical wall 140. A rubber or plastic gasket 142 having a U-shaped cross section fits over the lower edge or perimeter of the power dome 134 and seals the dome to the floor 32. The lower edge of the dome with the gasket thereon lies close against the outer periphery of the rib 38, the gasket thereby also sealing the come to the outer periphery of the rib.

An important aspect of the present invention is that the dome 134 is formed of a suitable non-conductive material. As a practical expedient for production purposes the dome is molded of a suitable plastic material, although it also could be made of a wood product, or turned from solid wood. The entire inner surface of the dome is coated with an elecrically conductive coating 144. The coating can be a metal foil adhesively secured in place. It can be metal electroplated, sputtered, or painted in place, or it can be any suitable conducting material. A specific example includes the graphite suspension known as aquadag presented on the inner or concave surface of the dome.

The dome and the boss 34 are relatively positioned such that the conductive coating 144 on the inner surface of the dome 134 presses down against the washer 56 when the dome is in place on the floor 32 to apply a negative high voltage to the conductive surface. This causes a negative high voltage electrostatic potential to overlie the outer or convex surface of the dome. The dome as will be seen covers the transformer, the fuse, and the high voltage rectifier unit, whereby all of the high voltage is completely sealed from prying fingers or conductive objects. A plastic or rubber spacer in the nature of a washer 146 spaces the top 26 of the cover 24 away from the top 136 of the dome 134. An insulating bolt 148, such as made of a suitable plastic material, extends through aligned holes in the top wall 26, and through the dome, and through the respective washers. The bolt may be threaded into the top wall 36 of the boss 34, and preferably there is a suitable nut member 150 secured beneath this wall for receipt of the bolt.

Figure 8:
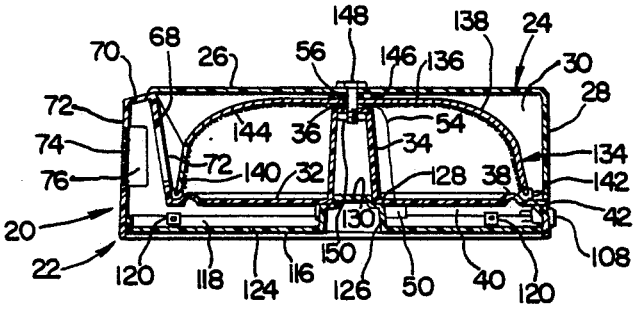
FIG. 8 is a cross-section through the base and dome as taken substantially along the line 8—8 in FIG. 2.

As will be seen in FIGS. 1 and 8 particularly, there are spaces between the lower edge of the side walls 28 and 30 of the cover and the relieved areas 42 and 44 of the base. Thus, air drawn into the generator by the muffin fan 76 is blown over the outer surface of the dome 134 and out through the relieved areas 42 and 44 beneath the lower edge of the cover walls. The air comes into contact only with non-conductive plastic material. However, with the high voltage direct current potential connected to the conductive coating on the inner surface of the dome, there is a high potential electrostatic field established over the entire outer surface of the dome.

Figure 9:
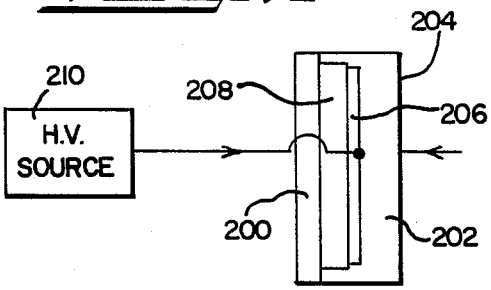
FIG. 9 is a diagrammatic illustration of a modified form of the invention wherein the radiating surface may comprise a portion of a wall or the like disposed within an enclosed space.

FIGS. 9 through 13 are intended to illustrate possible variations in physical configuration which a structure of the general type shown in FIGS. 1 through 8 can assume. In FIG. 9, there is shown an insulated frame or support 200 which may comprise the wall of an enclosed space or it may be recessed relative to the wall surface. An outer insulating covering 202 similarly may comprise an exposed surface 204 which is flush with a wall, or the covering 202 may extend outwardly from the normal wall surface. It should be understood that the invention contemplates that the surface 204 may be of any size including a size large enough to cover one or all of the walls and ceilings of an enclosed space.

Positioned between the support 200 and the insulating covering 202 is a conductive material in the form of a film or plate 206. This material, which may be supported on the surface of a dielectric material 208 is connected to high voltage source 210. In accordance with previous discussions, electrostatic charges may be developed over the surface of the member 206 with the nature thereof depending upon the magnitude and polarity of the high voltage applied.

In a typical application of the structure shown in FIG. 9, air in the vicinity of the electrostatically-charged member 206 will be affected. In a case where the air circulates naturally, even due to the effect of persons moving in the enclosed space, it may be unnecessary to provide a fan or the like in order to insure movement of air in the vicinity of the member 206.

Figure 10:
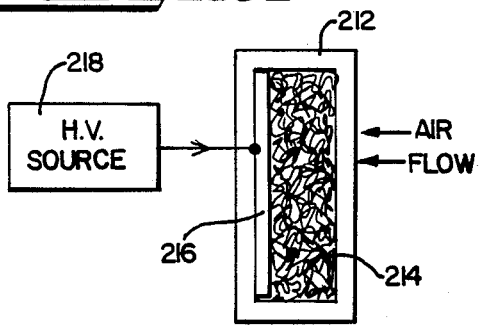
FIG. 10 is a diagrammatic illustration of another form of the invention wherein a radiating surface is disposed in a passage of a housing containing a filter medium.

In FIG. 10, a frame 212 which may take the form of a conduit or other enclosed housing, supports a filter medium 214. A conductive member in the form of film or plate 216 is connected to high voltage source 218 whereby electrostatic charges are developed in the area occupied bY the filter medium.

Forced air circulation is most suitable for an arrangement such as shown in FIG. 10 with the air being driven through perforations or the like in the direction shown in the figure or from end-to-end. With the presence of the filter medium, dirt particles and the like may be collected for providing cleaner air. Thus, the filter medium enhances the operation achieved bY the charging of particles in the air.

Figure 11:
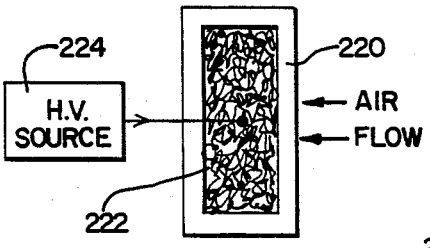
FIG. 11 is a diagrammatic illustration of another form of the invention wherein an electrically conductive filter medium is disposed within a housing to provide the radiating surface.

In FIG. 11, there is shown a frame 220 comparable to the frame 212. In this instance, a filter medium 222 of electrially conductive material such as graphite is employed. The high voltage source 224 is applied directly to this filter medium for achieving the combined advantages of electrostatic charging and filtering.

Figure 12:
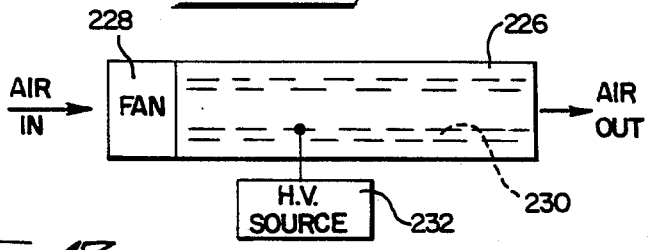
FIG. 12 is a diagrammatic illustration of another form of the invention wherein a tubular member or the like provides a radiating surface on its interior wall.

FIG. 12 illustrates a housing 226 having a fan 228 at one end for circulating air through the housing. A conductive surface 230 is connected to high voltage source 232 whereby an electrostatic charge is developed for acting upon air moving through the housing. As in the case of the frame 212 and 220, the housing 226 should be formed of insulating material so that no exposure of these members within the enclosed space occupied by people will be encountered.

Figure 13:
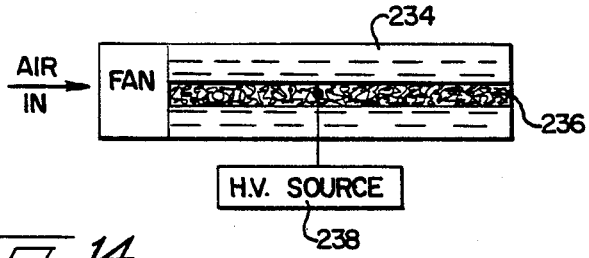
FIG. 13 is a diagrammatic illustration of another form of the invention wherein a tubular member is utilized in combination with an electrically conductive filter medium to provide a radiating surface.

FIG. 13 illustrates an arrangement wherein housing 234 encloses an electrically conductive filter medium 236. The high voltage source 238 therefore serves to develop an electrostatic field for acting upon air circulated through the housing 234.

Figure 14:
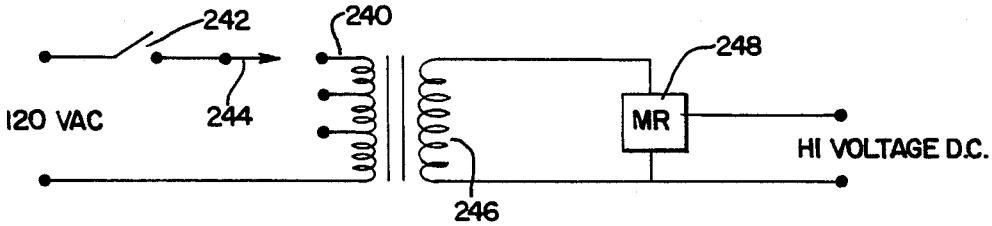
FIG. 14 is a schematic circuit diagram illustrating means for varying high voltage input.

For all of the structures described above, a power source such as shown schematically in FIG. 14 may be utilized. In this instance, a 120 volt AC input is provided to turns 240 through switch 242. The multi-positioned selector 244 is employed for varying the input to turns 246. The multiplier-rectifier 248 delivers high voltage DC input of a magnitude depending upon the position of selector switch 244. This input may be applied, for example, to the wire 54 utilized in connection with generator 20. Similarly, the arrangement may be employed for a high voltage source with respect to any of the arrangements shown in FIGS. 9 through 13.

Figure 15:
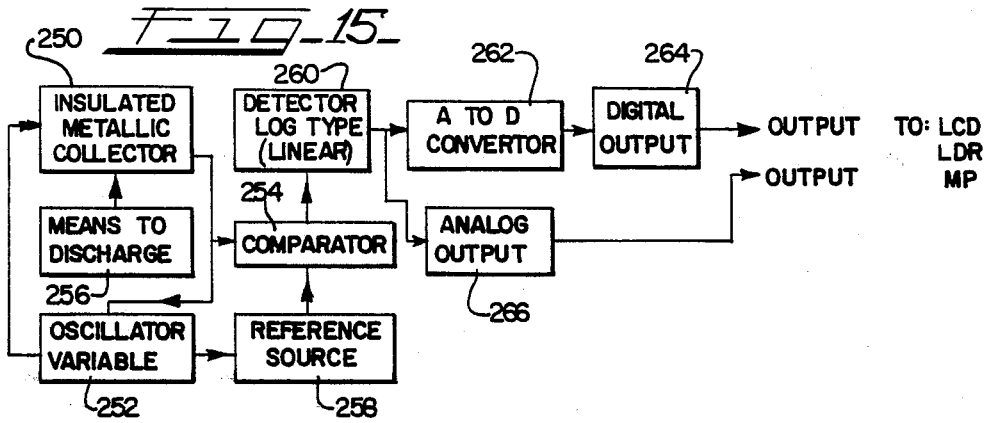
FIG. 15 is a schematic block diagram illustrating a detecting system suitable for use in conjunction with the invention.

FIG. 15 is a block diagram illustrating a sensor or detector system for measuring the polarity and magnitude of an electrostatic field or charge. This system includes an insulated metallic collector 250 which may comprise a metal plate suitably insulated from other conductive portions of the system and from earth potential. This arrangement provides for another metal or otherwise conductive plate in close proximity whiCh is driven by the variable oscillator 252. The amplitude of vibration achieved is proportional to the electrostatic field obtained, to the magnitude of the driving frequency, and to the frequency of the system. The amplitude involved is detected, and a corresponding signal sent to the comparator 254.

The "means to discharge" 256 comprises a suitable switch means for reducing the metallic conductor of collector 250 to earth potential. This function places the amplitude of vibration at a zero charge magnitude which when applied to comparator 254 is the same as the magnitude at the reference source 258 thereby producing a zero output from the comparator.

As indicated, the variable oscillator 252 serves as a source of frequency and as a means for controlling the magnitude thereof. Reference source 258 provides an output equal to the output of collector 250 when that collector is at zero potential. Comparator 254 comprises an electronic means providing an output proportional in magnitude and polarity to the output of the collector 250.

The detector 260 comprises an electronic means for converting the comparator output to a voltage with a core polarity proportional to the input to the collector. A linear-type detector log is contemplated.

The system includes an analog to digital converter 262 which provides a digital encoded output proportional to the polarity and magnitude of the detector output. The digital output 264 is used to drive a microprocessor LCD, LDR or other digital readout device. The digital output may be any conventional electronic device providing a low impedance signal which may be processed as indicated.

Analog output 266 from the detector comprises any conventional electronic device providing an output of low impedance for connection with a signal processing means such as a meter, recorder or modulator.

Figure 16:
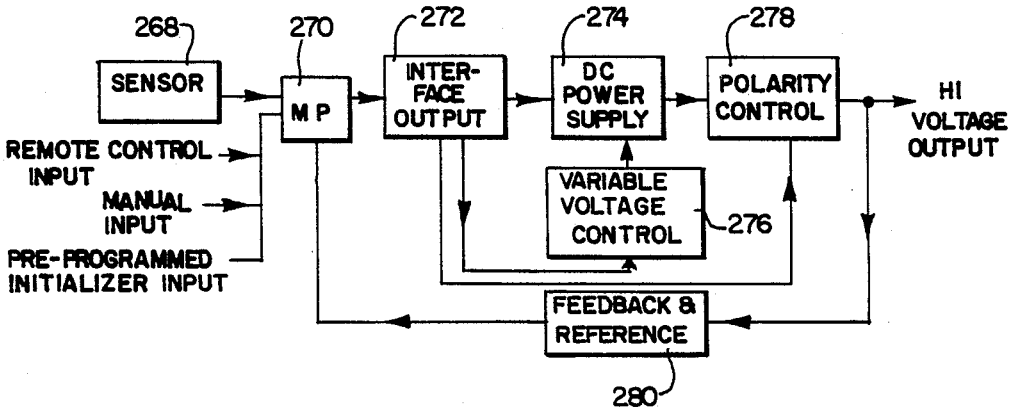
FIG. 16 is a schematic block diagram illustrating another form of detecting system for use in conjunction with the invention.

FIG. 16 illustrates an example of means for automatically controlling the output of an electron generator by controlling the magnitude of electrostatic field in a given environment, and/or the polarity of said field. The system is useful for achieving a predetermined high voltage and magnitude regardless of the natural electrostatic condition of the environment. The arrangement of FIG. 16 is particularly useful for achieving remote control of the electron generator output particularly in connection with a programable input which will achieve response from the generator to accomplish various magnitudes and polarities depending upon conditions sensed by the system.

The sensor 268 of FIG. 16 may be of the type shown in FIG. 15 or some other type. The microprocessor 270 may have a ROM, RAM or manual programable input. This unit will control the electron generator in response to various inputs from the sensor.

An interface output 272 provides low impedance outputs and switching means for operation of the electron generator. In particular, this output is applied to DC power supply 274 which provides a continuous high voltage of either plus or minus polarity. The power supply can be of various types including a high voltage transformer with or without diodes and capacitors providing DC input. Alternatively, fly-back circuit means with high voltage rectifiers may be utilized. Another alternative comprises class D type switching means having a high DC voltage output.

The system may employ a variable voltage control 276 which is responsive to the interface output 272 for thereby varying the electron generator output. Variable voltage control means may involve a tapped primary or secondary transformer. A variable input AC voltage to high voltage transformer, a system utilizing change of low DC voltage or frequency for fly-back or switching supplies, or a saturable reactor.

The polarity control means 276 serves to switch the system between plus or minus voltage outputs of the electron generator. A feed-back and reference means 280 may be utilized to sample the output thereby providing the microprocessor with simple data to control the microprocessor output as may be required by the various microprocessor inputs or programs.

Figure 17:
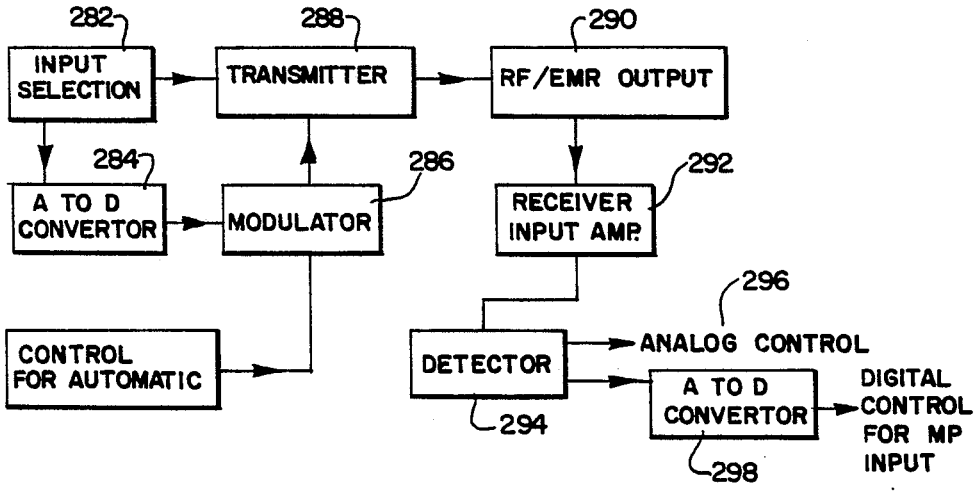
FIG. 17 is a schematic block diagram illustrating a remote control arrangement suitable for use in conjunction with the invention.

FIG. 17 provides an illustration of a system for achieving remote conrol of an arrangement such as shown in FIG. 16. This system includes input selection means 282 which comprises a selectable switching and electronic means providing manual data for control of electron generator output. An analog to digital converter 284 of the type described with reference to FIG. 15 receives input from input selection 282. The output from this converter is applied to modulator 286 which comprises an electronic means placing data on transmitter carrier 288. This carrier also receives input from the input selector 282 which may involve an output as described with reference to FIG. 16. The transmitter is thus responsive to digitally encoded data to provide maximum data transmission in a secure and short time period.

The RF/EMR output 290 receives input from transmitter 288 and provides a radio frequency signal for transmission "over hard wire" lines or for providing electromagnetic radiation through atmosphere. A receiver 292 will respond to and amplify the current o EMR data received. Detector 294 retrieves the digital or analog data for transmission to analog control 296. This control will cause the electron generator to respond to manual input data as determined by the input selection. The analog to digital converter 298 may provide output for digital control for microprocessor input. These analog or digital means responsive to the detector output provide control of the electron generator output as described with reference to FIG. 16.

In a typical use of the system, a negative polarity of a high voltage source will result in the air passing over the outer surface therefore becoming negatively charged. Particulate matter in the air becomes negatively charged and particles tend to agglomerate due to adherence thereof in their normally positive state with the negative ions, whereby the negative charge and gravity cause deposition of such particles on the ground, the floor, and on walls, etc. The particulate material therefore is removed from the air for cleaner air for breathing. Static electric charges are dispelled.

It is preferred that there be no high voltage conductive material with which the air comes into contact. It therefore is not possible for particulate matter in the air to deposit on such a conductive material to form points or high spots that could lead to arcing and ozone generation. The deleterious effects of ozone on human beings are well recognized, as are the color bleaching and deterioration of fabric and other materials with which the ozone comes in contact.

As has been indicated, major portions of the generator structures described may be molded of a suitable plastic material (sometimes known as plastic resin material, or resinous plastic material), whereby the structures can be made relatively inexpensively. Various structures for connecting the high voltage lead wire to the radiating surface, such as to the conductive convex surface of the dome of FIG. 3 may be emplyed. The structure may comprise taping a stripped portion of the wire to the conductive surface, or securing the wire to a metal tape secured to the conductive surface with a conductive adhesive. Other structure also can be used to secure the cover to the base.

The purifier may be a permanent part of a room or the like, or it can be placed on a horizontal supporting surface, where it may be supplied with a suitable device for hanging it on the wall in a relatively out of the way position. One specific embodiment of a structure as shown in FIGS. 1–8 is approximately thirteen by fourteen inches in outline with other dimensions scaled approximately as shown in the drawings. As noted, however, vastly different dimensions are contemplated insofar as practice of the invention as described herein is concerned.

The specific examples of the invention as herein shown and described are for illustrative purposes. Various changes in structure will no doubt occur to those skilled in the art, and will be understood as forming a part of the present invention insofar as they fall within the spirit and scope of the appended claims.

That which is claimed is:

1. An air quality control system for altering the state of small particles present in the air such as organisms, dust and smoke, an enclosed space comprising a source of high voltage, a charged surface exposed within said space adapted to develop either a positive or negative electrostatic charge on said surface, said surface being connected to said source of high voltage whereby a continuous electrostatic charge is applied to said surface, means for switching the polarity of said source of high voltage to achieve either a continuous and non-pulsing positive electrostatic charge, and means providing for circulation of air relative to said charged surface whereby the electrical charges of said small particles present in the air located proximate said charged surface are altered due to exposure to said electrostatic charge.

2. A system in accordance with claim 1 including means for varying the magnitude of said high voltage applied.

3. A system in accordance with claim 1 including means for detecting the charge of particles in the air, and means for controlling said switching means in response to the charge detected.

4. A system in accordance with claim 2 including means for detecting the charge of particles in the air, and means for controlling the means for varying the high voltage applied in response to the charge detected.

5. An air quality control system for altering the state of small particles present in the air such as organisms, dust and smoke, an enclosed space comprising a source of high voltage, a charged surface exposed within said space adapted to develop either a positive or negative electrostatic charge on said surface, said surface being connected to said source of high voltage whereby a continuous, non-pulsing, electrostatic charge is applied to said surface, means for varying the magnitude of the high voltage applied to thereby vary said continuous electrostatic charge, and means providing for circulation of air relative to said charged surface whereby the electrical charges of said smaller particles present in the air located proximate said charged surface are altered due to exposure to said electrostatic charge.

6. An system in accordance with claim 5 including means for detecting the charge of particles in the air, and means for controlling the means for varying the high voltage applied in response to the charge detected.

7. A system in accordance with either claims 1 or 9 wherein said radiating surface comprises a planar surface forming at least part of a control surface defining said enclosed space.

8. A system in accordance with claims 1 or 5 comprising a frame disposed within said enclosed space, a filter medium supported by said frame, and means for circulating said air through said filter medium, said charge radiating surface also being supported by said frame and being positioned adjacent said filter medium.

9. A system in accordance with either of claims 1 or 5 comprising a frame disposed within said enclosed space, a filter medium supported by said frame, and means for circulating air through said filter medium, said filter medium comprising electrically conductive material, and said high voltage source being connected to said filter medium whereby said filter medium provides said charge radiating surface.

10. A system in accordance with either of claims 1 or 5 including a housing defining an interior passage for movement of said air therethrough, and wherein said charge radiating surface defines at least part of the interior surface of said housing.

11. A system in accordance with either of claims 1 or 5 including a housing defining an interior passage for circulation of air therethrough, a filter medium disposed within said passage, and said charge radiating surface being disposed within said passage.

12. A system in accordance with claim 11 wherein said filter medium comprises electrically conductive material, and said source of high voltage being connected to said filter medium whereby said charge radiating surface is provided by said filter medium.

13. An air quality control system for altering the state of small particles present in the air such as organisms, dust and smoke, an enclosed space comprising a source of high voltage, a charged surface exposed within said space adapted to develop either a positive or negative electrostatic charge on said surface, said surface being connected to said source of high voltage whereby a continuous electrostatic charge is applied to said surface, means for switching the polarity of said source of high voltage to achieve either a continuous and non-pulsing positive electrostatic charge or a continuous and non-pulsing negative electrostatic charge, means providing for circulation of air relative to said charged surface, whereby the electrical charges of said small particles present in the air located proximate said charged surface are altered due to exposure to said electrostatic charge, means for detecting the charge of particles in the air, and microprocessor control means connected between said detecting means and said switching means for controlling said switching means in response to the charge detected.

14. An air quality control system for altering the state of small particles present in the air such as organisms, dust and smoke, an enclosed space comprising a source of high voltage, a charged surface exposed within said space adapted to developed either a positive or negative electrostatic charge on said surface, said surface being connected to said source of high voltage whereby a continuous electrostatic charge is applied to said surface, means for switching the polarity of said source of high voltage to achieve either a continuous and non-pulsing positive electrostatic charge or a continuous and non-pulsing negative electrostatic charge, means providing for circulation of air relative to said radiating surface whereby the electrical charges of said small particles present in the air located proximate said charged surface are altered due to exposure to said electrostatic charge, means for varying the magnitude of said high voltage applied, means for detecting the charge of particles in the air, and microprocessor control means connected between said detecting means and said means for varying the magnitude of said high voltage applied for controlling the means for varying the high voltage applied in response to the charge detected.

15. An air quality control system for altering the state of small particles present in the air such as organisms, dust and smoke, an enclosed space comprising a source of high voltage, a charged surface exposed within said space adapted to develop either a positive or negative electrostatic charge on said surface, said surface being connected to said source of high voltage whereby a continuous electrostatic charge is applied to said surface, means for switching the polarity of said source of high voltage to achieve either a continuous and non-pulsing positive electrostatic charge or a continous and non-pulsing negative electrostatic charge, means providing for circulation of air relative to said charged surface whereby the electrical charges of said small particles present in the air located proximate said charged surface are altered due to exposure to said electrostatic charge, and wherein said switching means is located remote from said enclosed space.

16. An air quality control system for altering the state of small particles present in the air such as organisms, dust and smoke, an enclosed space comprising a source of high voltage, a charged surface exposed within said space adapted to develop either a positive or negative electrostatic charge on said surface, said surface being connected to said source of high voltage whereby a continuous electrostatic charge is applied to said surface, means for switching the polarity of said source of high voltage to achieve either a continuous and non-pulsing negative electrostatic charge, means providing for circulation of air relative to said radiating surface whereby the electrical charges of said small particles present in the air located proximate said charged surface are altered due to exposure to said electrostatic charge, and including means for varying the magnitude of said high voltage applied, and wherein said means for varying the magnitude of said high voltage applied is located remote from said enclosed space.

17. An air quality control system for altering the state of small particles present in the air such as organisms, dust and smoke, an enclosed space comprising a source of high voltage, a charged surface exposed within said space adapted to develop either a positive or negative electrostatic charge on said surface, said surface being connected to said source of high voltage whereby a continuous, non-pulsing, electrostatic charge is applied to said surface, means for varying the magnitude of the high voltage applied to thereby vary said continuous electrostatic charge, means providing for circulation of air relative to said charged surface whereby the electrical charges of said small particles present in the air located proximate said charged surface are altered due to exposure to said electrostatic charge, means for detecting the charge of particles in the air, and microprocessor control means connected between said detecting means and said means for varying the magnitude of said high voltage applied for controlling the means for varying the high voltage applied in response to the charge detected.

18. An air quality control system for altering the state of small particles present in the air such as organisms, dust and smoke, an enclosed space comprising a source of high voltage, a charged surface exposed within said space adapted to develop either a positive or negative electrostatic charge on said surface, said surface being connected to said source of high voltage whereby a continuous, non-pulsing, electrostatic charge is applied to said surface, means for varying the magnitude of the high voltage applied to thereby vary said continuous electrostatic charge, means providing for circulation of air relative to said charged surface whereby the electrical charges of said small particles present in the air located proximate said charged surface are altered due to exposure to said electrostatic charge, means for detecting the charge of particles in the air, and means for controlling the means for varying the high voltage applied in response to the charge detected, and wherein said means for varying the magnitude of said high voltage applied is located remote from said enclosed space.

19. An air quality control system for altering the state of small particles present in the air such as organisms, dust and smoke, an enclosed space comprising a source of high voltage, a charged surface exposed within said space adapted to develop either a positive or negative electrostatic charge on said surface, said surface being connected to said source of high voltage whereby a continuous non-pulsing electrostatic charge is applied to said surface, means for varying the magnitude of the high voltage applied to thereby vary said continuous electrostatic charge, means providing for circulation of air relative to said charged surface whereby the electrical charges of said small particles present in the air located proximate said charged surface are altered due to exposure to said electrostatic charge, and means for switching from a continuous positive electrostatic charge to a continuous negative electrostatic charge.

* * * * *